US005760537A

United States Patent [19]

Friederichs

[11] Patent Number: 5,760,537

[45] Date of Patent: Jun. 2, 1998

[54] CAPPED ELECTRIC LAMP

[75] Inventor: Winand H. A. M. Friederichs, Eindhoven, Netherlands

[73] Assignee: U.S. Philips Corporation, New York, N.Y.

[21] Appl. No.: 738,943

[22] Filed: Oct. 24, 1996

[30] Foreign Application Priority Data

Oct. 26, 1995 [EP] European Pat. Off. ..... 95202908

[51] Int. Cl.[6] ..... H01J 5/50

[52] U.S. Cl. ..... 313/318.03; 313/318.01; 313/318.1; 439/611; 439/613

[58] Field of Search ..... 313/318.01, 318.03, 313/318.1, 318.11; 439/611, 613

[56] References Cited

U.S. PATENT DOCUMENTS

| | | | |
|---|---|---|---|
| 805,131 | 11/1905 | Gerow | 439/613 |
| 3,885,185 | 5/1975 | Tilley | 313/318.1 |
| 3,885,186 | 5/1975 | Vause | 313/318.1 |
| 5,199,787 | 4/1993 | King et al. | 362/310 |
| 5,281,880 | 1/1994 | Fields et al. | 313/113 |
| 5,367,219 | 11/1994 | Fredrichs | 313/113 |

FOREIGN PATENT DOCUMENTS

0601865A1 6/1994 European Pat. Off. .

*Primary Examiner*—Nimeshkumar Patel
*Attorney, Agent, or Firm*—Walter M. Egbert

[57] ABSTRACT

A capped electric lamp is disclosed having a cap of insulating material. The cap has a base provided with concentric contact faces which are separated by a circumferential channel. The shell of the cap has a first axial portion near the base, which has a circumferential groove and a diameter smaller than the diameter of a second axial portion remote from the base. A third narrowest axial portion may be present adjacent the base and a fourth axial portion between the first and the second, having an intermediate diameter. The capped lamp may be mounted in an electrically safe, slim push-in/push-out lampholder.

13 Claims, 2 Drawing Sheets

CAPPED ELECTRIC LAMP

BACKGROUND OF THE INVENTION

The invention relates to a capped electric lamp comprising:

a lamp vessel which is closed in a vacuumtight manner and in which an electric element is arranged;

current conductors issuing from the lamp vessel to the exterior and electrically connected to the electric element;

a lamp cap of electrically insulating material connected to the lamp vessel, which lamp cap has a shell with an axis and a substantially rotationally symmetrical surface, and a base transverse to the axis of the shell, on which base a first, central contact surface and, on a circle concentric with the axis, a second contact surface are present, which contact surfaces are electrically connected to the current conductors, the shell having a circumferential groove adjacent the base.

Such a capped electric lamp is known from EP-A-0 601 865.

The known lamp is suitable for being accommodated in a push-in/push-out lampholder of a type also known from the cited document in that it is simply pressed with its lamp cap into this lampholder. The lampholder releases the lamp again when the latter is pressed deeper into the holder with its lamp cap. This is attractive because of the simplicity and ease of placing the lamp in and removing it from the lampholder. Another advantage is that the lamp may be used in a luminaire which is so narrow that it is impossible to grip around the lamp vessel, such as is necessary for removing a lamp through rotation or pulling.

The rotational symmetry of the lamp cap and of the contacts of the known lamp renders it possible in addition to place the lamp in the lampholder in any rotational position.

It is a disadvantage of the known lamp, however, that its lamp cap has the result that the lampholder is dangerous to touch when the lamp is not present therein. This is the more important as the lampholder is destined for a discharge lamp which is ignited at a high voltage or which requires re-ignition in the hot state at a voltage of a few kV. In view of these high voltages, it is important for the electrical safety of the lamp that the lamp cap is made of an electrically insulating material, although this requires a much greater wall thickness for the mechanical strength of the lamp cap than if the lamp cap were made of metal.

The lamp cap, however, must be comparatively wide in the case of electric lamps whose lamp vessels are accommodated in an outer envelope, for example in a reflector body, so as to provide a possibility of coupling it to this envelope. Such reflector lamps are known from, for example, U.S. Pat. No. 5,367,219, U.S. Pat. No. 5,281,889, and U.S. Pat. No. 5,199,787. They are also described in Applications of earlier date: U.S. Pat. No. 5,556,191 to Maassen, U.S. Pat. No. 5,646,473 to Eggink et al., allowed U.S. application Ser. No. 08/607,960 filed Feb. 29, 1996, U.S. Pat. No. 5,667,297 to Maassen et al., allowed U.S. application Ser. No. 08/615,758 filed Mar. 13, 1996, and co-pending U.S. application Ser. No. 08/705,571 filed Aug. 29, 1996. A lamp cap made of insulating material is very voluminous for such a lamp. This is a disadvantage because in that case the lampholder for this lamp is also very voluminous.

It is a disadvantage of the lamp mentioned in the opening paragraph that the cylindrical lamp cap is comparatively wide, so that the lampholder is comparatively voluminous, while nevertheless the lamp cap has a very thin wall, and is accordingly mechanically weak, at the area where it surrounds the outer envelope of the lamp vessel.

SUMMARY OF THE INVENTION

It is an object of the invention to provide a capped electric lamp of the kind described in the opening paragraph which is suitable for use in a push-in/push-out lampholder, for example of the type mentioned, which renders it possible for the lampholder to be safe to touch when the lamp is absent and for the lamp cap to have a comparatively great mechanical strength accompanied by a comparatively small volume, and which is suitable for a comparatively slim lampholder.

According to the invention, this object is achieved in that a circumferential channel is present in the base between the first and the second contact surface, and the shell has a first axial portion in which the circumferential groove is present and a second axial portion extending from an end remote from the base, the first axial portion having a smaller diameter than the second.

The circumferential channel renders it possible for the lampholder to have a collar around a first contact member which serves to make contact with the first contact surface of the lamp cap, so that said contact member lies recessed in a cavity and this member can no longer be reached by the standard test finger. The lampholder is safe to touch when the first contact member is connected to the live lead of the supply, while the contact surfaces of the lamp cap still make electrical contact with the contact members of the lampholder thanks to the circumferential channel in which the collar can be accommodated.

The comparatively small diameter of the first axial portion renders it possible to give the lampholder a comparatively small width. The comparatively wide second axial portion can remain outside the lampholder when the lamp is inserted. The second portion renders it possible to accommodate a comparatively wide outer envelope while retaining a sufficient thickness of the shell wall in situ. The diameter jump from the second axial portion may also be useful as an abutment on the housing of the lampholder in order to prevent the exertion of undesirable compression forces on the interior of the lampholder.

In a favorable embodiment, the shell has a third axial portion at an end adjacent the base of a diameter smaller than that of the first axial portion. This embodiment renders it possible to provide a second collar in the lampholder around a second annular contact member which is to connect with the second contact surface of the lamp cap, so that the second contact member lies recessed in a channel-shaped cavity. This embodiment has the advantage on the one hand that, if the live lead of the supply is not connected to the first, but inadvertently to the second contact member of the lampholder, it is nevertheless prevented that current can be taken off from the contact member with a standard test finger. This embodiment also has the advantage that the lamp cap itself provides space for such a second collar, and the second collar does not lead to a diameter increase of the lampholder.

In a favorable embodiment, the shell has, between the first and the second axial portion, a fourth axial portion having a diameter which lies between the diameters of the first and the second axial portion. Owing to its stepped diameter reduction, this embodiment offers the possibility of creating extra space in the lampholder for a retention member of the lampholder which is to grip into the circumferential groove in the narrow, first axial portion so as to keep the lamp fixed in the holder. The fourth axial portion is in addition useful for guiding the lamp cap when it is introduced into a lampholder.

It is favorable when the diameter jump at the end of the first axial portion remote from the base gives the lamp cap a transverse surface. The surface may then have a predetermined, well-defined position relative to the circumferential groove in the first axial portion and may serve as an application surface for a release member in the lampholder which looses the retention member.

In a favorable embodiment, the first contact surface is a base portion of a bush for the purpose of easy mounting. Said bush may be provided with clamping fit around a central portion of the base. The second contact surface may be a base portion of an annular channel which grips with clamping fit around an edge portion of the base, with a first channel wall against the shell and a second channel wall inside the circumferential channel in the base. An annular second contact surface has the advantage over a second contact surface on a circular arc that the lamp cap can make contact with a lampholder whose second contact member is annular as well as with one where this contact member lies on a circle concentric with the first contact member.

The lamp cap may be made from ceramic material, for example steatite or alumina, or a synthetic resin, for example a thermoplastic synthetic resin, for example, polyether imide, polyphenylene sulphide, or LCP (liquid crystalline polymer), whether or not charged and reinforced, for example, with fibres, for example glass fibres.

The lamp vessel may be made of glass, for example hard-glass or glass with an $SiO_2$ content of at least 96% by weight, such as quartz glass, or of a ceramic material such as, for example, sintered alumina. The electric element may be an incandescent body, for example a tungsten incandescent body, for example in an inert gas comprising a halogen, or alternatively a pair of electrodes in an ionizable medium such as, for example, in rare gas with metal halides, possibly with mercury. The electric element may be accommodated in an inner envelope, for example made of ceramic material.

The lamp vessel may be accommodated in an outer envelope, for example in a blown bulb or in a reflector body, for example made of moulded glass, with a concave reflecting surface. This body may be closed off with a transparent plate or a lens and may support the lamp cap.

BRIEF DESCRIPTION OF THE DRAWINGS

An embodiment of the capped electric lamp according to the invention is shown in the drawing, in which.

DESCRIPTION OF THE PREFERRED EMBODIMENT

Figure 1:
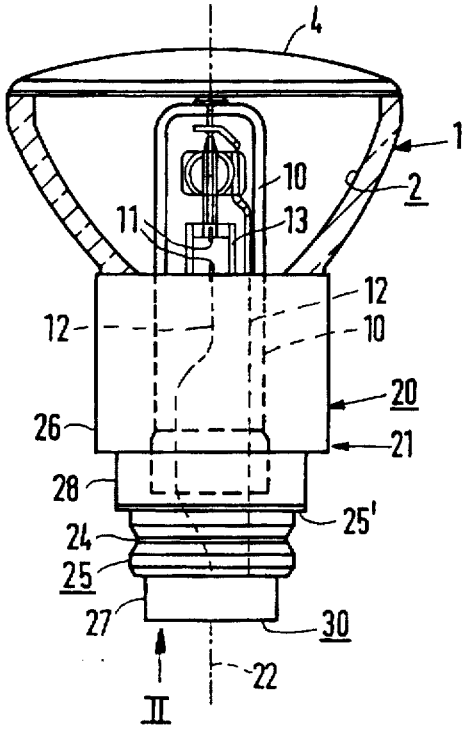
FIG. 1 shows a capped electric lamp in side elevation, partly in axial sectional view.

In FIG. 1, the capped electric lamp has a lamp vessel 10, of quartz glass in the Figure, which is closed in a vacuumtight manner and in which an electric element 11 is arranged. The electric element in the Figure is a pair of electrodes in an ionizable ambience of rare gas, metal halides, and mercury. The pair of electrodes is accommodated in an inner envelope 13 of sintered alumina. Current conductors 12 electrically connected to the electric element issue from the lamp vessel to the exterior. The lamp vessel 10 is fastened in a reflector body which has a concave reflecting surface 2 and which is closed off with a cover 4, i.e. a plate or lens. A lamp cap 20 of electrically insulating material, made of ceramic material in the Figure, for example of steatite, is connected to the lamp vessel in that it is also fastened to the reflector body, for example with cement such as lamp cement, or alternatively mechanically. The lamp cap 20 has a shell 21 with an axis 22 and a substantially rotationally symmetrical surface, and furthermore a base 30 transverse to the axis of the shell. A first, central contact surface 31 is present at the base 30 and, on a circle concentric with the axis 22, a second contact surface 32. Said contact surfaces are electrically connected to the current conductors 12. The shell 21 has a circumferential groove 24 near the base 30.

Figure 2:
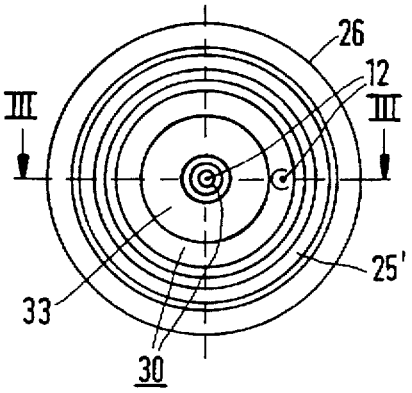
FIG. 2 is an axial view of the lamp cap viewed along II in FIG. 1 without contact surfaces, shown on an enlarged scale.
Figure 3:
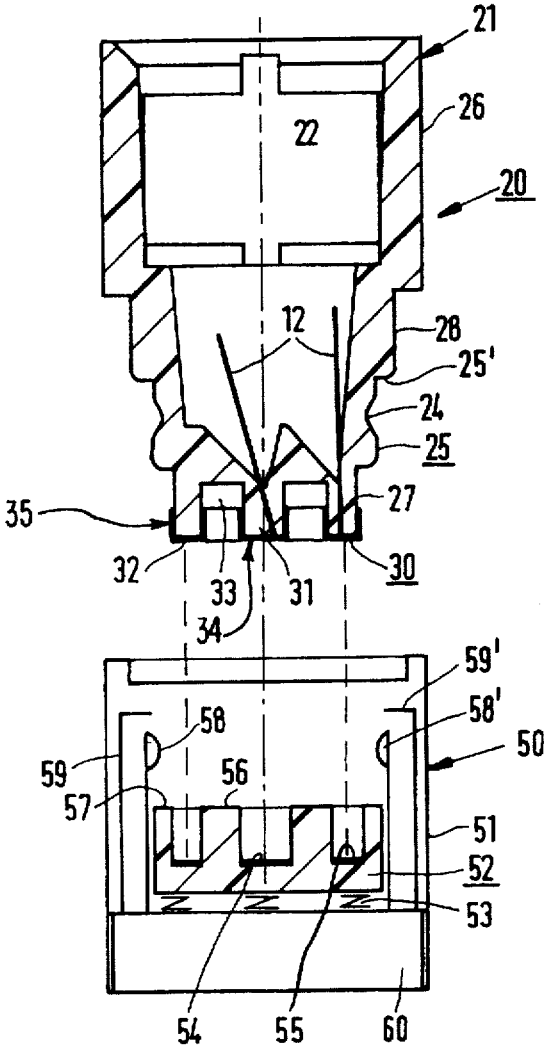
FIG. 3 is an axial sectional view of the lamp cap taken on the line III—III in FIG. 2, depicted above an axial sectional view of a lampholder.

A circumferential channel 33 is present in the base 30 between the first 31 and the second contact surface 32, see also FIGS. 2 and 3. The shell 21 has a first axial portion 25, see FIG. 3, in which the circumferential groove 24 is present, and a second axial portion 26 extending from an end remote from the base 30. The first axial portion 25 has a smaller diameter than the second 26.

The circumferential groove 24 is of symmetrical shape in the Figure, and its walls enclose an obtuse angle in axial cross-sections, for example, of 120°±15°. The groove is thus suitable for accommodating a hemispherical surface of a retention member of a lampholder. A retention member thus formed may readily grip into the groove with locking action and may readily slide along the lamp cap shell towards the groove and, when the retention member is released, slide away from the groove along the shell.

In the lamp shown, the shell 21 has a third axial portion 27 of smaller diameter than the first axial portion 25 at an end near the base 30. A contact block 51 of small dimension in the lampholder, see FIG. 3, which is substantially not wider than the first axial portion 25 and accordingly offers space to retention members 58, can as a result enclose the contact surfaces entirely and screen them off from their surroundings. This renders it possible to make the lampholder of metal, which renders possible a lampholder of small volume.

The shell 21 has between the first axial portion 25 and the second axial portion 26 a fourth axial portion 28 whose diameter lies between the diameters of the first 25 and the second axial portion 26. This portion provides a guidance when the lamp cap is introduced into a holder. In addition, this portion renders it possible for the first axial portion 25 to have its small diameter as shown in the drawing. This small diameter would offer too little space to the lamp vessel 10 without the fourth axial portion, also because of the mechanically required wall thickness of the shell.

It is favorable to position the diameter jump in a plane 25' directed transversely to the axis 22 at the end of the first axial portion 25 remote from the base. The lamp cap then has a well-defined application surface for a releasing member of the lampholder which is to loose the retention member. In the absence of such a surface, however, the releasing member may be operated, for example, via the contact block. It is an advantage that the lamp cap of the lamp according to the invention renders it possible for the retention member and the mechanism of the lampholder for releasing the retention member to pass no current and to be without a voltage. Heat generation in the mechanism, for example also caused by contact resistances, which could damage the movability of the mechanism, are avoided thereby and the lampholder may be constructed from metal, slim yet mechanically strong.

The first contact surface 31 is the base portion of a bush 34, and the second contact surface 32 is the base portion of an annular channel 35.

In FIG. 3, the lampholder 50 has a housing 51 of metal in which a contact block 52 is kept positioned by springs 53 with axial resilience. The contact block 52 has a first, centrally placed contact member 54 which is to make electrical contact with the first central contact surface 31 of the lamp cap 20, which member 54 is surrounded by a collar 56, so that it lies recessed in a cavity. A second annular contact member 55 which is to contact the second contact surface 32 of the lamp cap is concentric with the first and lies recessed in a channel-type cavity owing to the presence of a second collar 57. When the lamp is mounted, the collar closes around the third axial portion 27 of the shell 21 and thus isolates live parts from their surroundings. The lampholder has retention members 58, 58' which each have a hemispherical projection for gripping into the circumferential groove 24 with locking action. The lampholder has releasing members 59, 59' which can be brought into contact with the transverse surface 25' and which, when depressed, loose the retention member 58, 58' or 58', 58, as applicable, via the mechanism 60, so that the lamp can be taken from the holder. The retention members 58, 58', the releasing members 59, 59' and the mechanism 60 are not under electrical tension during operation.

I claim:

1. A capped electric lamp comprising:

a lamp vessel which is closed in a vacuumtight manner and in which an electric element is arranged;

current conductors issuing from the lamp vessel to the exterior and electrically connected to the electric element;

a lamp cap of electrically insulating material connected to the lamp vessel, said lamp cap having a shell with an axis and a substantially rotationally symmetrical surface, and a base transverse to the axis of the shell, on which base a first, central contact surface and, on a circle concentric with the axis, a second contact surface are present, which contact surfaces are electrically connected to the current conductors, the shell having a circumferential groove adjacent the base, wherein a circumferential channel is present in the base between the first contact surface and the second contact surface, and the shell has a first axial portion in which the circumferential groove is present and a second axial portion extending from an end remote from the base, the first axial portion having a smaller diameter than the second axial portion.

2. A capped electric lamp as claimed in claim 1, wherein the shell has a third axial portion at an end adjacent the base of a diameter smaller than that of the first axial portion.

3. A capped electric lamp as claimed in claim 1, wherein the shell has, between the first and the second axial portion, a fourth axial portion having a diameter which lies between the diameters of the first and the second axial portion.

4. A capped electric lamp as claimed in claim 1, wherein the first axial portion is bounded by a substantially transverse surface at an end of this portion remote from the base.

5. A capped electric lamp as claimed in claim 1, wherein the circumferential groove in the first axial portion is substantially symmetrical and has walls which enclose an obtuse angle.

6. A capped electric lamp as claimed in claim 1, wherein the first contact surface is a portion of a bush and the second contact surface is a portion of an annular channel.

7. A capped electric lamp as claimed in claim 2, wherein the shell has, between the first and the second axial portion, a fourth axial portion having a diameter which lies between the diameters of the first and the second axial portion.

8. A capped electric lamp as claimed in claim 2, wherein the first axial portion is bounded by a substantially transverse surface at an end of this portion remote from the base.

9. A capped electric lamp as claimed in claim 3, wherein the first axial portion is bounded by a substantially transverse surface at an end of this portion remote from the base.

10. A capped electric lamp as claimed in claim 2, wherein the circumferential groove in the first axial portion is substantially symmetrical and has walls which enclose an obtuse angle.

11. A capped electric lamp as claimed in claim 3, wherein the circumferential groove in the first axial portion is substantially symmetrical and has walls which enclose an obtuse angle.

12. A capped electric lamp as claimed in claim 2, wherein the first contact surface is a portion of a bush and the second contact surface is a portion of an annular channel.

13. A capped electric lamp as claimed in claim 3, wherein the first contact surface is a portion of a bush and the second contact surface is a portion of an annular channel.

* * * * *